United States Patent [19]

Hooper

[11] 4,034,913

[45] July 12, 1977

[54] COMPOSITE RAILROAD TIE

[76] Inventor: David K. Hooper, 7573 Macomb Road, Grosse Ile, Mich. 48138

[21] Appl. No.: 661,610

[22] Filed: Feb. 26, 1976

[51] Int. Cl.[2] ..... E01B 3/32

[52] U.S. Cl. ..... 238/98; 238/62; 238/91

[58] Field of Search ..... 238/62, 63, 83–85, 238/91, 92, 94–96, 98, 29, 50, 56, 72, 86, 87

[56] References Cited

U.S. PATENT DOCUMENTS

| | | | |
|---|---|---|---|
| 912,731 | 2/1909 | Riegler | 238/91 |
| 1,215,112 | 2/1917 | Chesney | 238/92 X |
| 1,524,750 | 2/1925 | Rea | 238/91 X |
| 2,695,754 | 11/1954 | Karig | 238/91 |

FOREIGN PATENT DOCUMENTS

| | | | |
|---|---|---|---|
| 941,980 | 4/1956 | Germany | 238/34 |
| 220,455 | 7/1942 | Switzerland | 238/29 |

*Primary Examiner*—Stanley H. Tollberg
*Assistant Examiner*—Fred A. Silverberg
*Attorney, Agent, or Firm*—Barnes, Kisselle, Raisch & Choate

[57] ABSTRACT

An improved railroad tie constructed of a metal sheath with angled walls braced longitudinally, vertically, and laterally and reinforced by a filling of concrete, the sheath structure being especially adapted for spring-type rail securing devices bridging the side walls of the shell. Hand-hold recesses are provided at the ends to facilitate manual handling of the ties.

8 Claims, 6 Drawing Figures

FIG. 3

COMPOSITE RAILROAD TIE

This invention relates to a Composite Railroad Tie and more particularly to a tie which utilizes no wood or wood substitute in its construction.

BACKGROUND AND OBJECTS OF INVENTION

Numerous efforts have been made to provide a railroad tie which would replace the long used wooden ties. An example is found in the disclosure of the U.S. Pat. No. 1,312,020 (1919) to Davis, or Robinson, U.S. Pat. No. 909,940 (1909). Wooden ties are subject to weathering or rotting, and, in places of high heat, such as steel plants or track areas where fungible loads need to be thawed before dumping, the wooden ties are soon destroyed.

The use of metal composite ties on the other hand has produced higher cost, greater weight, and the need for a nailing area which is difficult. Also, a structural tie which is too rigid is not a good substitute for a wooden tie. Another desirable feature of a railroad tie is the ability to withstand the abuse and shock of a derailment. In addition, since ties are handled manually in the building of track, it is desirable to provide a tie which can readily be moved by track hands to the trucks and from the trucks to a ground location.

The present invention is directed to a composite tie construction which provides an excellent substitute for wooden ties and which has many advantages over the traditional wooden tie.

An object, therefore, of the present invention is to provide an economical railroad tie which utilizes no wood elements and which has general weight, flexible and strength characteristics similar to the familiar wood ties but which offers a considerably longer, useful life particularly under adverse environmental conditions.

Another object is the provision of a tie structure which has the tie plates directly attached thereto so that they do not have to be nailed on or bolted on.

A further object is a composite tie to which the rails may be fastened with an operative clip device which can be readily assembled.

A yet further object is the provision of a tie which is capable of withstanding destruction by high heat or open flame such as that encountered near blast furnaces or in areas where a fungible load is being thawed preparatory to unloading or dumping.

A further object is the provision of a tie which is specifically resistant to damage by derailment and a tie which has an inherent strength by reason of the shape of the walls, the disposition of reinforcement rods, and cooperation of the elements of the assembly to provide a load distribution which resists destruction under severe usage.

DESCRIPTION OF THE DRAWINGS

Drawings accompany the disclosure and the various views thereof may be briefly described as.

Figures 1, 2, 3:
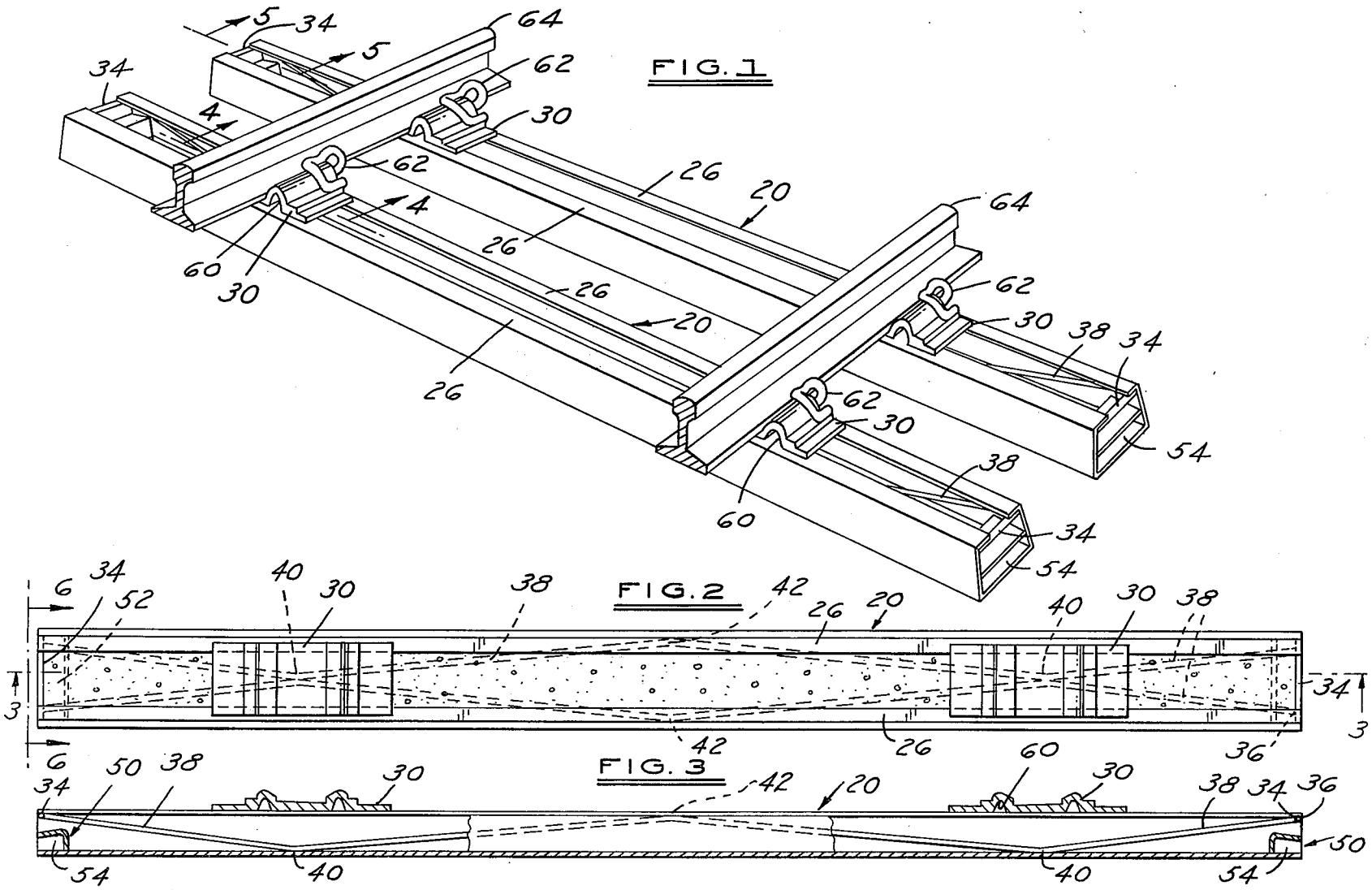
FIG. 1, a perspective view of a track assembly utilizing the improved tie construction.
FIG. 2, a plan view of the metal portions of the tie construction.
FIG. 3, a longitudinal sectional view of the tie.

As will be seen from the drawings, the tie consists of an outer steel casing 20 which is formed either by roll forming or by a metal forming brake machine so that the side walls 22 slope inwardly from the base 24 and the top of the side walls is bent inwardly to provide flanges 26 lying in a plane parallel to the base. Thus, in this configuration, the bottom of the tie is as wide as conventional ties now in use and the top of the tie has a dimension which is essentially equivalent to the width of the tie plate to be used. This tie plate is shown at 30 in FIGS. 1, 2 and 4.

Figure 4:
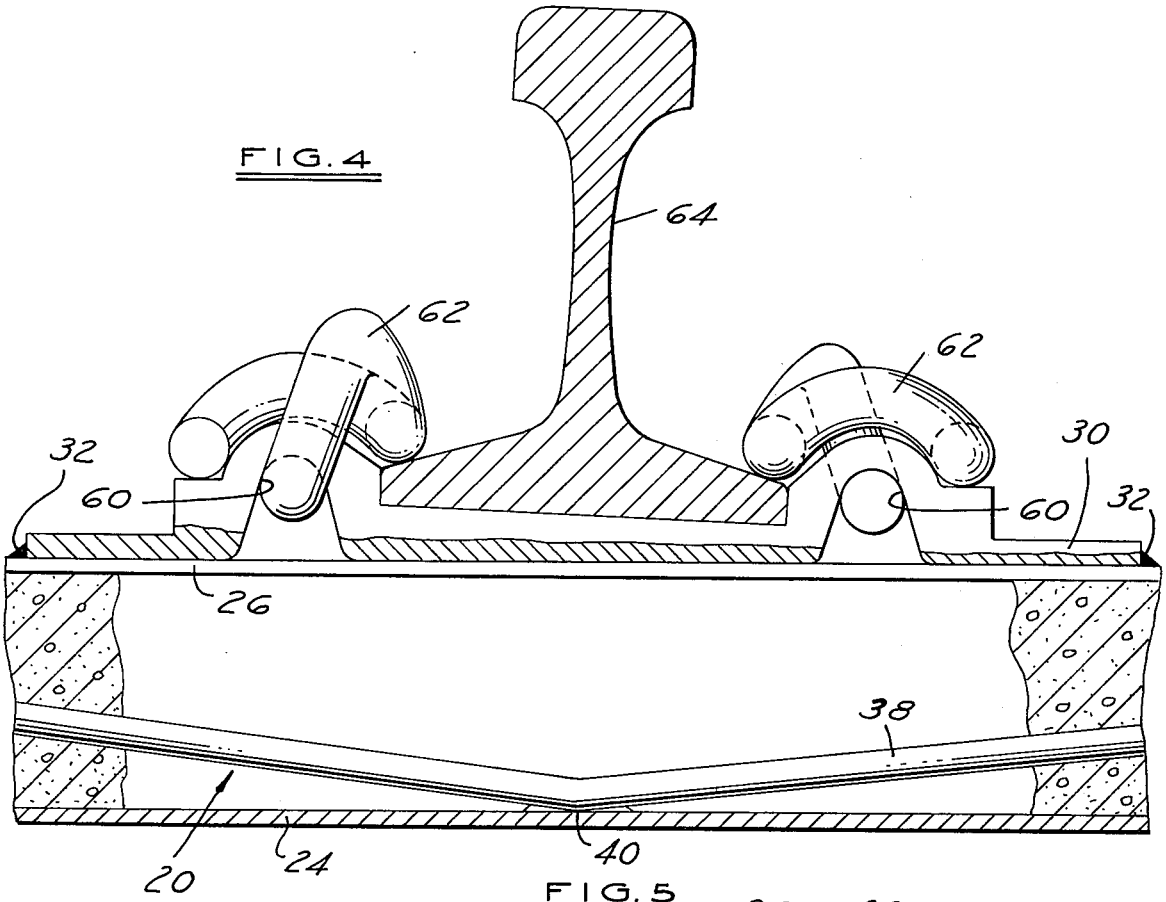
FIG. 4, a sectional view taken on line 4—4 of FIG. 1.

The base of the tie plate is welded to the two top flanges 26 in a secure manner as shown, for example, at 32 in FIG. 4.

Reverting to the construction of the tie itself, as viewed in FIGS. 2 and 3, reinforcing bars extend lengthwise of the interior of the tie. A buttress rod 34 is welded at each end of the tie to the under sides of the top flanges 26 to bridge the gap between these flanges. Reinforcing rods 38 are then formed to butt against the ends of this rod at 36 and on each side of each tie is one of the reinforcing rods 38 which angles down from this butting area 36 to a point 40 centrally of the base 24 as shown at the convergence 40 in FIG. 6 and then tapers upwardly to a contact point 42 underneath a side flange and then downwardly to a second convergence point 40 and upwardly to the abutment 36 against a bridging rod 34 at the other end.

Figure 6:
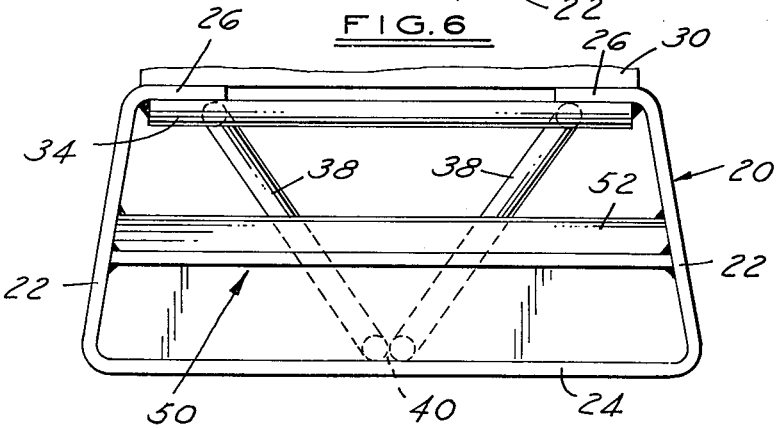
FIG. 6, an end view taken at line 6—6 of FIG. 2.

It will thus be seen that the reinforcing rods viewed in FIGS. 2, 3 and 6 form triangular structural sections in both the vertical and horizontal planes which provide a great deal of reinforcement to the steel shell 20. The rods 38 abut and are welded at the convergence points 40 to strengthen each other at the base and are welded into the corner point between the side wall 22 and the upper flange 26 at the points 42 to receive structural reinforcement at these points.

It will be noted also that the plates 30 which are welded to the top flanges 26 perform a bridging and reinforcing function in tying the two sides together in a rigid manner. As shown best in FIG. 6, the inwardly sloping side walls 22 with the overlying flanges 26 form a triangular load bearing structure with the rods 38. Thus, a top load on the tie is distributed to the base at the corners and at the center and each side tends to strenghten the other. Thus, there is load distribution throughout the entire structure which materially lessons the possibility of fatigue and breakdown.

Figure 5:
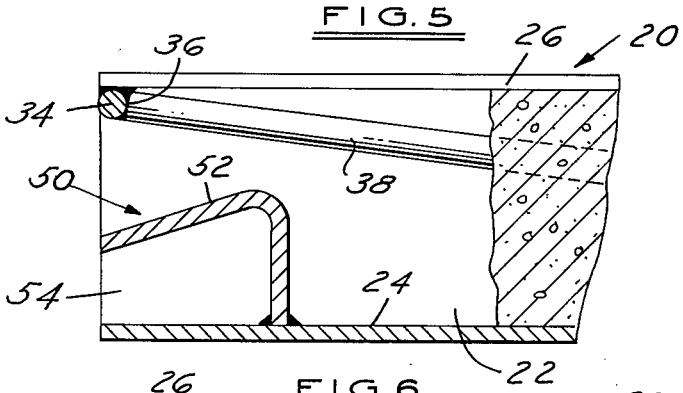
FIG. 5, a sectional view taken on line 5—5 of FIG. 1.

As shown best in FIG. 5 in cross-section, a handle-hold cavity is formed by welding an L-shaped plate 50 to the base and sides of the unit directly adjacent each end. One leg of the L 52 is angled inwardly and upwardly to provide a re-entrant angle and a cavity 54 with an upwardly sloping top wall which makes it easy for the fingers of a workman's hand to grip the end of the tie. Once the metal structural parts of the tie are positioned and welded in place, the tie is filled with a concrete. An ordinary concrete made with a construction cement (Type III High Early Strength) can be used. If extreme heat conditions are to be met, a more expensive concrete made with a calcium aluminate cement may be used. The members 50 prevent the cavities 54 from being filled so that these remain as hand-hold pockets. However, the members 34 and 38 will be completely embedded in the concrete.

The rods 38 are, in essence, each shaped in the form of a wide-spread out W (FIGS. 2 and 3) which lies at an angle to the vertical as shown best in FIG. 6. The rods are welded at the ends and the upper and lower apices of the W to the interior walls and flanges of the shell and to each other at the meeting points as well as to the inner walls of the outer casing. This provides the triangular load carrying components which distribute the stress exerted on any portion of the tie over a wide area. Preferably the tie is finished by coating it with a rust inhibitive paint epoxy or similar substance.

The tie plates shown best in FIGS. 1 and 4 have recesses 60 which cooperate with a leg of a spring have recesses 60 which cooperate with a leg of a spring clip 62 which is driven into the opening over the base flange of the rail 64 to hold the rails in place. It will be seen that the metal housing 20 is secured at the top by the end cross rods 34 and the rail plates 30 which are securely welded to the top flanges 26. When the housing is filled by concrete, the flanges protect the interior fill in the event of a derailment so that the rails are not as subject to destruction or dislodgement when hit by the wheels or undercarriage of a derailed car.

What I claim is:

1. An improvement in a reinforced, concrete filled railroad tie which comprises:

a. an elongate metallic shell extending the length of the tie having a base and integral side walls having a top portion wherein said side walls extend upwardly from the base to the height of the tie, and b. a pair of reinforcing rods spanning substantially the length of the tie, each formed in a configuration of a wide W, each lying in a plane intersecting the base midway between the side walls and intersecting the top portion of each of said side wall, said formed rods having its free ends and its apices secured to the base and the side walls of the shell, the shell being filled with concrete to cover and embed the reinforcing rods.

2. A railroad tie as defined in claim 1 in which a bridging rod is bridged across the top of the side walls at each end of the housing and the ends of the elongate rods are abutted against and secured to said bridging rods.

3. A railroad tie as defined in claim 1 in which said shell has inwardly projecting flanges at the top of the side walls disposed substantially parallel to the base, said ends and top apices of said reinforcing rods being confined by said flanges.

4. A railroad tie as defined in claim 1 in which the upwardly extending side walls are angled inwardly and upwardly from the edges of the base to form structural triangles transversely of the tie.

5. A railroad tie as defined in claim 1 in which the respective bottom apices of the W of each rod are in contact with each other as well as with the base of the shell proximate to rail supports on the tie to reinforce each other longitudinally and laterally of the shell.

6. A railroad tie as defined in claim 1 in which the shell has inwardly projecting flanges at the top of the side walls disposed substantially parallel to the base, said top apices of said W rods being wedged into the corner of said side walls and said flanges on each side respectively to enhance the strength of said structure.

7. A railroad tie as defined in claim 1 in which means is provided at each end of a completed tie to provide a transverse recess extending across the tie parallel to the base to serve as a hand hold to facilitate handling of the tie.

8. A railroad tie as defined in claim 7 in which said means comprises an L-shaped plate extending between the side walls of the shell, the top portion of the plate being disposed at an angle extending upwardly from the end of the tie to provide a hand gripping surface.

* * * * *